US008521321B2

(12) United States Patent
Tashiro et al.

(10) Patent No.: US 8,521,321 B2
(45) Date of Patent: Aug. 27, 2013

(54) SEWING MACHINE SYSTEM, SEWING MACHINE, AND STORAGE DEVICE

(75) Inventors: Noriharu Tashiro, Nagoya (JP); Tsuneo Okuyama, Inabe-gun (JP); Satomi Suzuki, Nagoya (JP); Masahiro Mizuno, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 120 days.

(21) Appl. No.: 13/323,216

(22) Filed: Dec. 12, 2011

(65) Prior Publication Data

US 2012/0165970 A1 Jun. 28, 2012

(30) Foreign Application Priority Data

Dec. 27, 2010 (JP) ..... 2010-291249

(51) Int. Cl.
*D05C 5/02* (2006.01)

(52) U.S. Cl.
USPC ..... 700/138; 112/470.01

(58) Field of Classification Search
USPC ..... 700/136–138; 112/102.5, 445, 470.01, 112/470.04, 475.18, 475.19
See application file for complete search history.

(56) References Cited

U.S. PATENT DOCUMENTS

| | | | | |
|---|---|---|---|---|
| 5,231,941 | A | 8/1993 | Wakayama | |
| 5,881,662 | A * | 3/1999 | Bastian et al. | 112/470.04 |
| 5,924,372 | A * | 7/1999 | Okuda et al. | 700/138 |
| 5,924,374 | A * | 7/1999 | Mori et al. | 112/102.5 |
| 5,988,083 | A * | 11/1999 | Tomita et al. | 112/102.5 |
| 6,317,129 | B2 * | 11/2001 | Tomita | 112/102.5 |
| 6,446,177 | B1 | 9/2002 | Tanaka et al. | |
| 7,685,072 | B2 * | 3/2010 | Hirata | 700/136 |
| 2008/0103624 | A1 | 5/2008 | Yamada | |
| 2009/0138120 | A1 | 5/2009 | Yamada | |
| 2010/0139538 | A1 | 6/2010 | Tashiro | |
| 2011/0160894 | A1 | 6/2011 | Yamada | |

FOREIGN PATENT DOCUMENTS

| | | |
|---|---|---|
| JP | A-05-049766 | 3/1993 |
| JP | A-2000-112824 | 4/2000 |
| JP | A-2001-017757 | 1/2001 |

OTHER PUBLICATIONS

Extended European Search Report issued in European Patent Application No. 11194023.5 dated May 7, 2012.
Extended European Search Report issued in British Patent Application No. 11194023.5 dated May 7, 2012.

* cited by examiner

*Primary Examiner* — Nathan Durham
(74) *Attorney, Agent, or Firm* — Oliff & Berridge, PLC

(57) ABSTRACT

A sewing machine system includes a sewing machine and a storage device. The storage device includes an embroidery information storage portion, a conditions information storage portion, and a use history storage portion. The sewing machine includes a mounting portion to and from which the storage device can be mounted and removed, a first individual unit information storage portion that stores the first individual unit information, a use conditions determination portion that determines whether the sewing machine corresponds to the use conditions information, a usability determination portion that determines whether the embroidery information that is stored in the embroidery information storage portion can be used, a first decryption portion that decrypts the embroidery information, an individual unit information storage control portion that stores in the use history storage portion the first individual unit information, and an embroidery portion that performs embroidery sewing on a cloth.

18 Claims, 14 Drawing Sheets

FIG. 6

95

| USE CONDITIONS INFORMATION | |
|---|---|
| DESTINATION INFORMATION | JAPAN |
| | AMERICA |
| | CHINA |
| MACHINE MODEL INFORMATION | BB-CC |
| | SSS-XXX |
| | DD-EEE |
| EMBROIDERY TYPE INFORMATION | FIRST COPYRIGHT |
| | SECOND COPYRIGHT |
| | ORDINARY |

FIG. 8

97

| MACHINE MODEL-RELATED INFORMATION | |
|---|---|
| FIRST INDIVIDUAL UNIT INFORMATION | aabbcc |
| DESTINATION INFORMATION | JAPAN |
| MACHINE MODEL INFORMATION | SSS-XXX |
| EMBROIDERY TYPE INFORMATION | FIRST COPYRIGHT |
| | ORDINARY |

FIG. 13

98

| FIRST INDIVIDUAL UNIT INFORMATION |
| --- |
| aabbcc |
| — |
| — |

FIG. 14

98

| FIRST INDIVIDUAL UNIT INFORMATION |
| --- |
| ddeeff |
| gghhii |
| jjkkmm |

SEWING MACHINE SYSTEM, SEWING MACHINE, AND STORAGE DEVICE

CROSS-REFERENCE TO RELATED APPLICATION

This application claims priority to Japanese Patent Application No. 2010-291249, filed Dec. 27, 2010, the content of which is hereby incorporated herein by reference.

BACKGROUND

The present disclosure relates to a sewing machine system, a sewing machine, and a storage device that perform embroidery on a cloth based on embroidery information.

A sewing machine is known that sews an embroidery pattern on a cloth based on embroidery information that is stored in a storage device. For example, a sewing machine with an embroidery device is known that can select and sew a desired embroidery pattern from among a plurality of embroidery patterns for which embroidery data are stored in a ROM card that is mounted in the sewing machine.

SUMMARY

In a case where the sewing machine that is described above includes a card slot in which the ROM card can be mounted, the sewing machine is able to read the embroidery data (the embroidery information) that is stored in the ROM card. The same ROM card may be used improperly in an unspecified large number of sewing machines.

Various embodiments of the broad principles derived herein provide a sewing machine system, a sewing machine, and a storage device that are capable of restricting the number of sewing machines in which embroidery information that is stored in a storage device can be used.

Embodiments provide a sewing machine system that includes a sewing machine and a storage device that can be mounted to and removed from the sewing machine. The storage device includes an embroidery information storage portion that is configured to store embroidery information that is information for the sewing machine to perform embroidery sewing, that is encrypted, and that can be decrypted by using a first decryption key, a conditions information storage portion that is configured to store use conditions information that is information on conditions for a sewing machine that can use the embroidery information, and a use history storage portion that is configured to store a specified number of records of first individual unit information for respective sewing machines that have used the embroidery information. Each of the records of the first individual unit information identifies an individual sewing machine. The sewing machine includes a mounting portion to and from which the storage device can be mounted and removed, a first individual unit information storage portion that stores the first individual unit information of the sewing machine, and a use conditions determination portion that determines whether the sewing machine corresponds to the use conditions information by referencing the use conditions information that is stored in the conditions information storage portion of the storage device that is mounted in the mounting portion. The sewing machine also includes a usability determination portion that, in a case where it has been determined by the use conditions determination portion that the sewing machine corresponds to the use conditions information, determines whether the embroidery information that is stored in the embroidery information storage portion can be used, by at least one of determining whether a number of records of the first individual unit information that are stored in the use history storage portion is less than the specified number and determining whether the first individual unit information of the sewing machine is stored in the use history storage portion, and a first decryption portion that, in a case where it has been determined by the usability determination portion that the embroidery information that is stored in the embroidery information storage portion can be used, decrypts the embroidery information that is stored in the embroidery information storage portion by using the first decryption key. The first decryption key is stored in a decryption key storage portion that stores a decryption key. The sewing machine further includes an individual unit information storage control portion that, in a case where it has been determined by the usability determination portion that the number of the records of the first individual unit information that are stored in the use history storage portion is less than the specified number and thus the embroidery information that is stored in the embroidery information storage portion can be used, stores in the use history storage portion the first individual unit information that is stored in the first individual unit information storage portion, and an embroidery portion that performs embroidery sewing on a cloth, using the embroidery information that has been decrypted by the first decryption portion.

Embodiments also provide a sewing machine that includes a mounting portion to and from which a storage device can be mounted and removed. The storage device includes an embroidery information storage portion, a conditions information storage portion, and a use history storage portion. The embroidery information storage portion is configured to store embroidery information that is information for a sewing machine to perform embroidery sewing, that is encrypted, and that can be decrypted by using a first decryption key. The conditions information storage portion is configured to store use conditions information that is information on conditions for a sewing machine that can use the embroidery information. The use history storage portion is configured to store a specified number of records of first individual unit information for respective sewing machines that have used the embroidery information. Each of the records of the first individual unit information identifies an individual sewing machine. The sewing machine also includes a first individual unit information storage portion that stores the first individual unit information of the sewing machine, a use conditions determination portion that determines whether the sewing machine corresponds to the use conditions information by referencing the use conditions information that is stored in the conditions information storage portion of the storage device that is mounted in the mounting portion, and a usability determination portion that, in a case where it has been determined by the use conditions determination portion that the sewing machine corresponds to the use conditions information, determines whether the embroidery information that is stored in the embroidery information storage portion can be used, by at least one of determining whether a number of records of the first individual unit information that are stored in the use history storage portion is less than the specified number and determining whether the first individual unit information of the sewing machine is stored in the use history storage portion. The sewing machine further includes a first decryption portion that, in a case where it has been determined by the usability determination portion that the embroidery information that is stored in the embroidery information storage portion can be used, decrypts the embroidery information that is stored in the embroidery information storage portion by using the first decryption key, the first decryption key being stored in a decryption key storage portion that stores a decryption key, an individual unit information storage control portion that, in a case where it has been determined by the usability determination portion that the number of the records of the first individual unit information that are stored in the use history storage portion is less than the specified number and thus the embroidery information that is stored in the embroidery information storage portion can be used, stores in the use history storage portion the first individual unit information that is stored in the first individual unit information storage portion, and an embroidery portion that performs embroidery sewing on a cloth, using the embroidery information that has been decrypted by the first decryption portion.

Embodiments further provide a storage device that can be mounted to and removed from a sewing machine. The storage device includes an embroidery information storage portion that is configured to store embroidery information that is information for the sewing machine to perform embroidery sewing, that is encrypted, and that can be decrypted by using a first decryption key stored in the sewing machine. The storage device also includes a conditions information storage portion that is configured to store use conditions information that is information on conditions for a sewing machine that can use the embroidery information, and a use history storage portion that is configured to store a specified number of records of first individual unit information for respective sewing machines that have used the embroidery information. Each of the records of the first individual unit information identifies an individual sewing machine.

BRIEF DESCRIPTION OF THE DRAWINGS

Embodiments will be described below in detail with reference to the accompanying drawings in which:

FIG. 6 is a schematic diagram that shows a use conditions information data table 95;

FIG. 8 is a schematic diagram that shows a machine model-related information data table 97;

FIG. 13 is a schematic diagram that shows the use history data table 98; and FIG. 14 is a schematic diagram that shows the use history data table 98.

DETAILED DESCRIPTION

Hereinafter, an embodiment will be explained with reference to the drawings. First, a configuration of a sewing machine system 1 will be explained with reference to FIGS. 1 and 2. The right rear, the left front, the right front, and the left rear in FIG. 1 are respectively the right, the left, the front, and the rear of a sewing machine 2.

Figure 1:
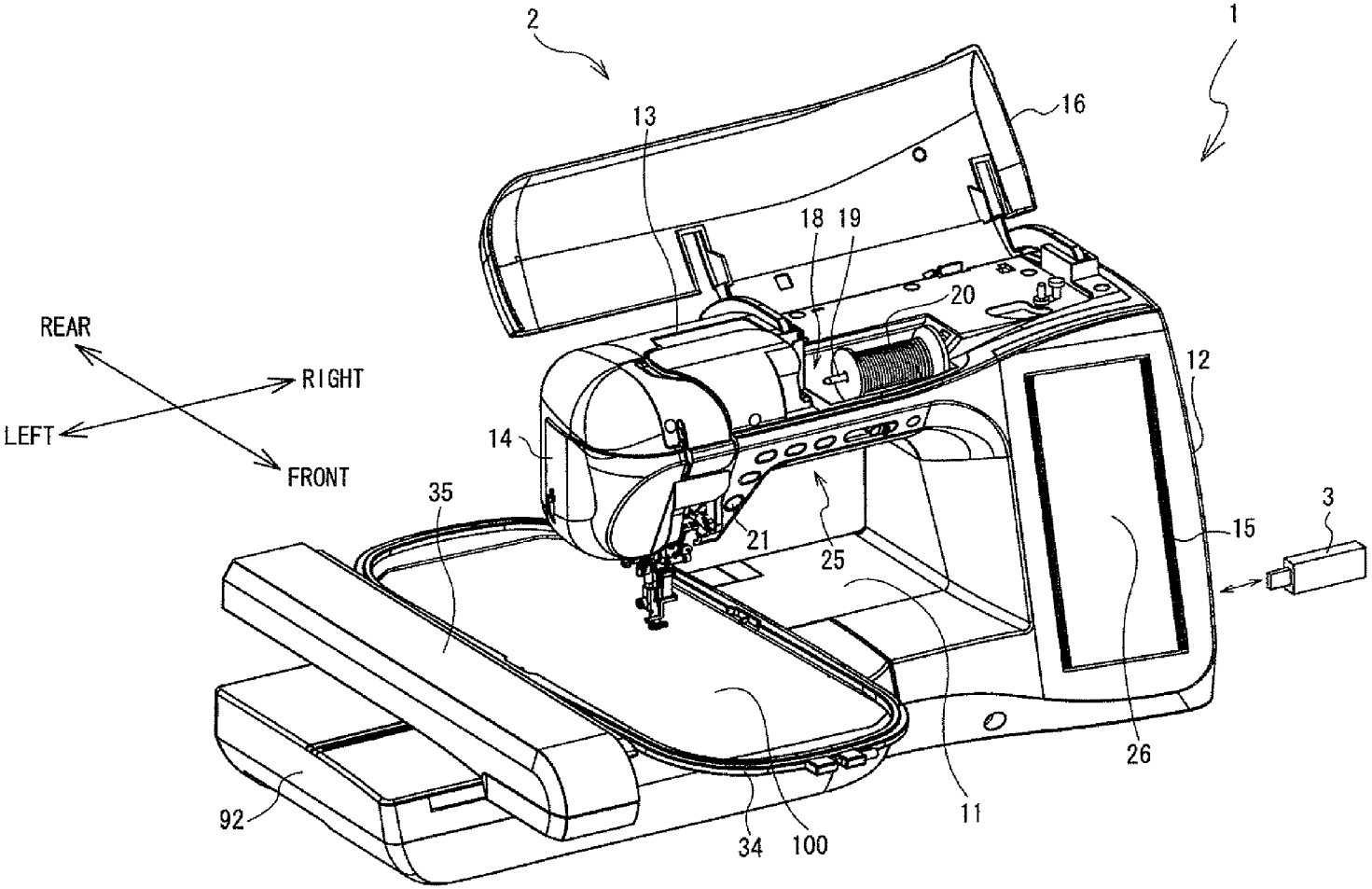
FIG. 1 is an oblique view of a sewing machine system 1.

As shown in FIG. 1, the sewing machine system 1 includes a sewing machine 2 and a Universal Serial Bus (USB) memory 3. The USB memory 3 can be mounted in and removed from the sewing machine 2. The sewing machine 2 includes a bed 11, a pillar 12, an arm 13, and a head 14. The bed 11 is the base of the sewing machine 2 and extends in the left-right direction. The pillar 12 extends upward from the right end of the bed 11. The arm 13 extends to the left from the upper end of the pillar 12. The head 14 is provided on the left end of the arm 13. A needle plate (not shown in the drawings) is provided in the top surface of the bed 11. A feed dog (not shown in the drawings), a cloth feeding mechanism (not shown in the drawings), a feed adjustment pulse motor 78 (refer to FIG. 3), and a shuttle mechanism (not shown in the drawings) are provided inside the bed 11 below the needle plate. The feed dog may move a work cloth that is sewn by a specified feed amount. The cloth feeding mechanism drives the feed dog. The feed adjustment pulse motor 78 adjusts the feed amount.

An embroidery frame 34 that holds a work cloth 100 may be disposed on top of the bed 11. The area inside the embroidery frame 34 is an embroidery area in which stitches of an embroidery pattern can be formed. An embroidery frame transfer device 92, which may move the embroidery frame, 34 can be mounted on and removed from the bed 11. A carriage cover 35, which extends in the front-rear direction, is provided on the top portion of the embroidery frame transfer device 92. A Y axis transfer mechanism (not shown in the drawings) is provided inside the carriage cover 35. The Y axis transfer mechanism may move a carriage (not shown in the drawings) in a Y axis direction (the front-rear direction). The embroidery frame 34 can be mounted on and removed from the carriage. A mounting portion (not shown in the drawings), where the embroidery frame 34 can be mounted, is provided to the right of the carriage. The mounting portion projects to the right from the right side face of the carriage cover 35. An attaching portion (not shown in the drawings) that is provided on the left side of the embroidery frame 34 may be mounted on the mounting portion. The carriage, the Y axis transfer mechanism, and the carriage cover 35 may be moved in an X axis direction (the left-right direction) by an X axis transfer mechanism (not shown in the drawings). Accordingly, the embroidery frame 34 may be moved in the X axis direction by the X axis transfer mechanism. The X axis transfer mechanism is provided within the main body of the embroidery frame transfer device 92.

Figure 2:
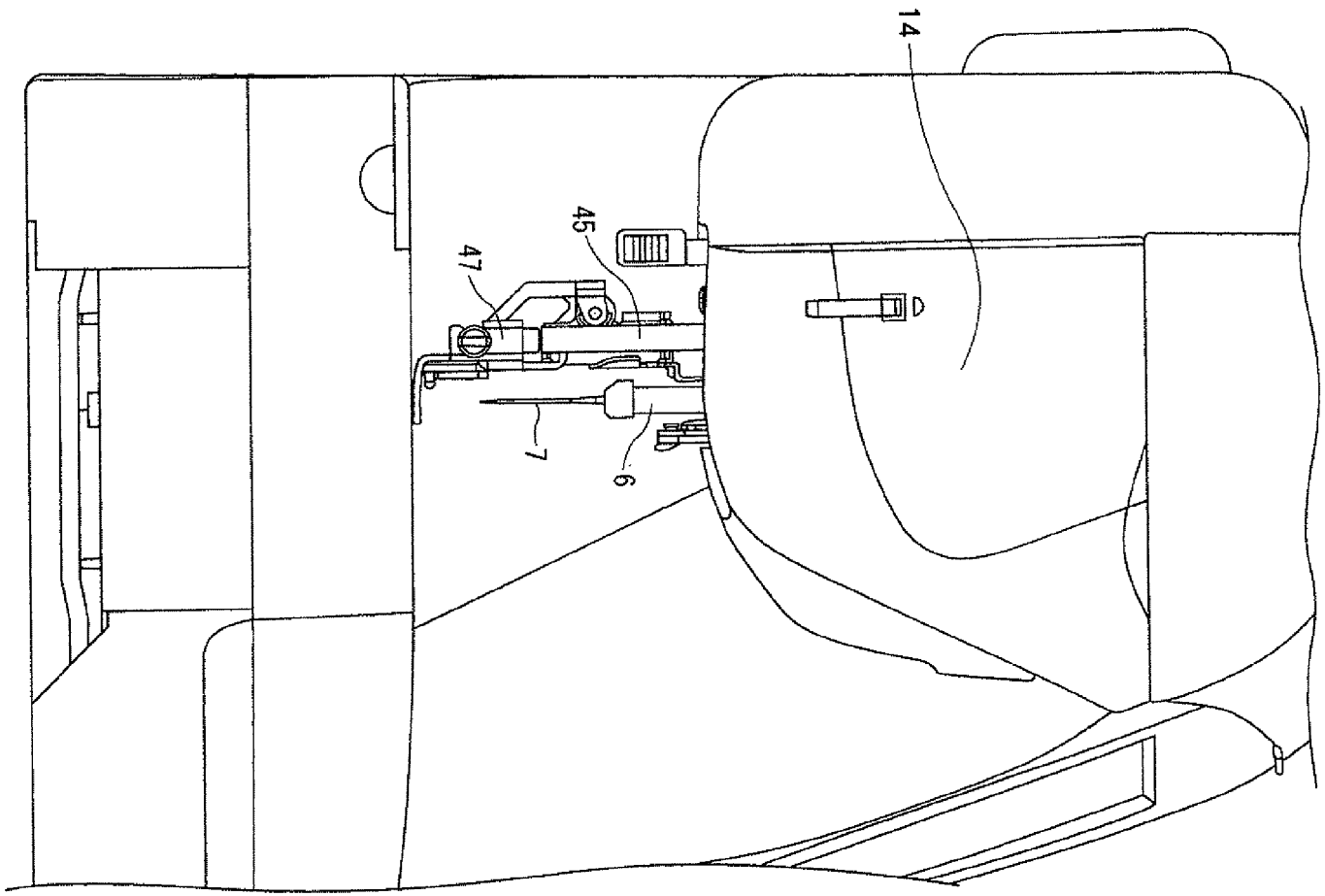
FIG. 2 is a left side view of a main portion that shows a needle bar 6, a needle 7, a presser bar 45, a presser foot 47, and the area around these members.
Figure 3:
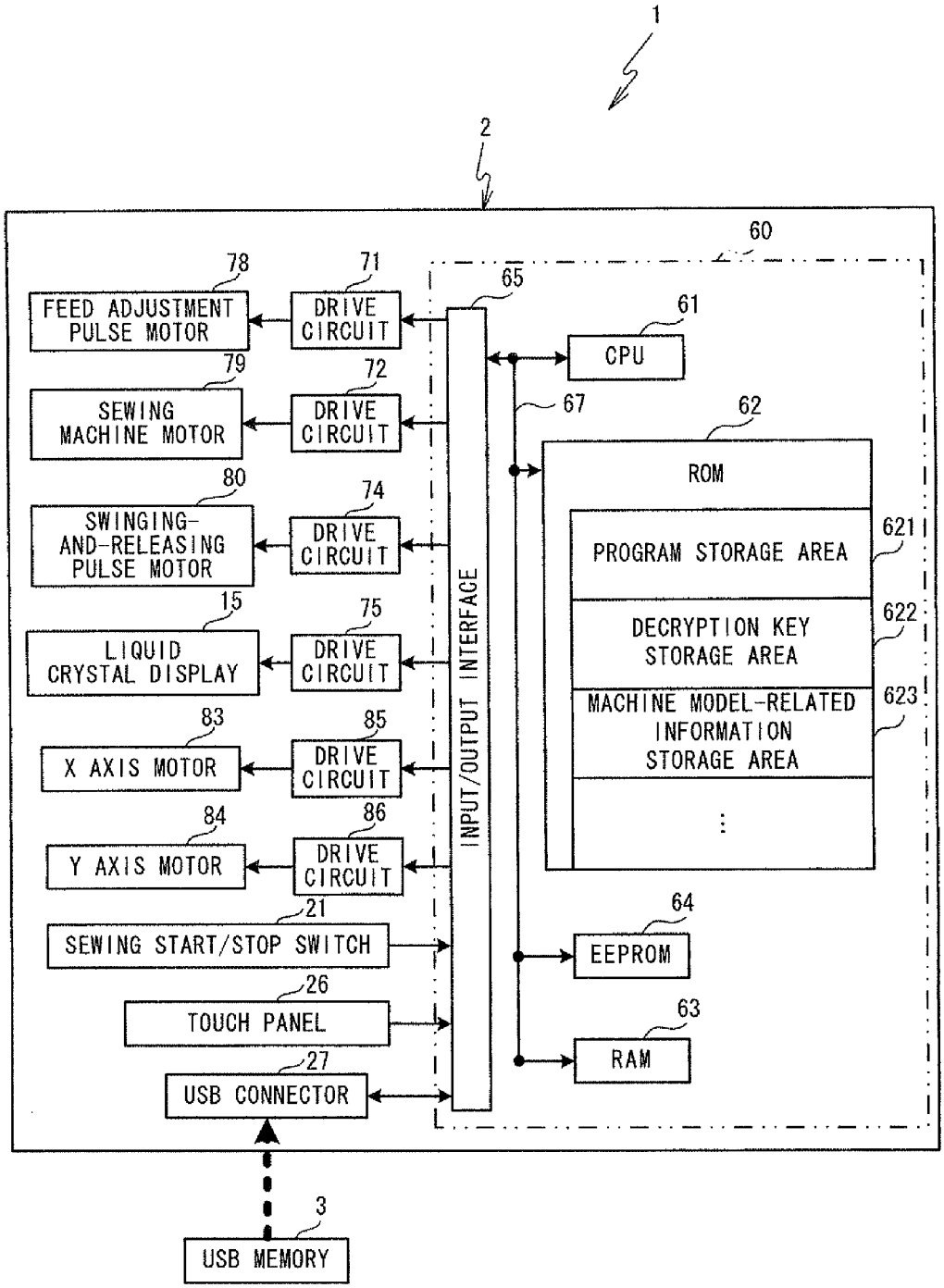
FIG. 3 is a schematic diagram that shows an electrical configuration of the sewing machine system 1.
Figure 12:
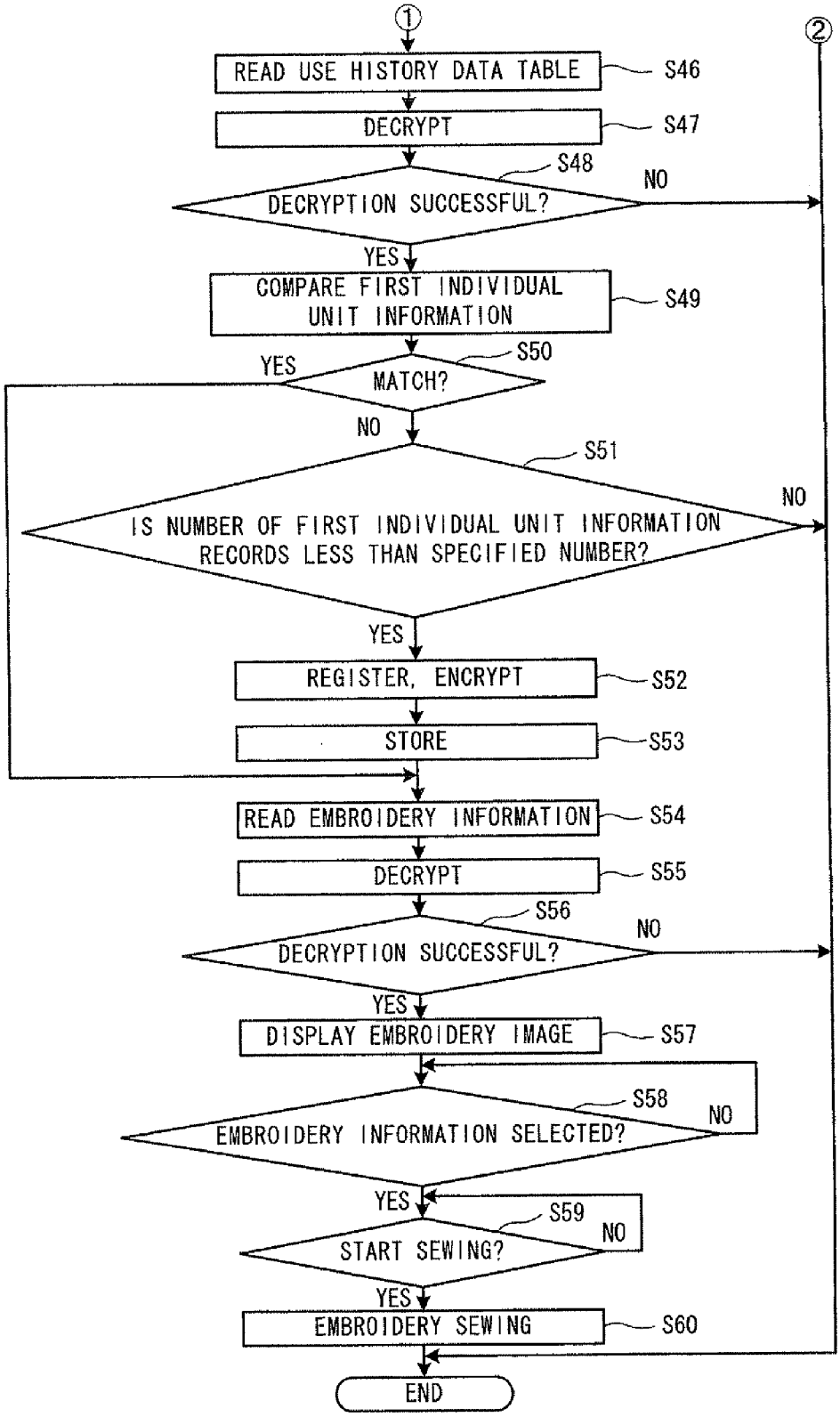
FIG. 12 is another portion of the flowchart that shows the main processing.

The X axis transfer mechanism and the Y axis transfer mechanism are respectively driven by an X axis motor 83 (refer to FIG. 3) and a Y axis motor 84 (refer to FIG. 3). As the embroidery frame 34 is moved in the X axis direction and the Y axis direction, a needle bar 6 (refer to FIG. 2) and the shuttle mechanism (not shown in the drawings) may be driven. A pattern forming operation may be thus performed that forms a pattern of specified stitches, a specified embroidery pattern, or the like on the work cloth 100 that is held by the embroidery frame 34. In the present embodiment, based on embroidery information, embroidery sewing is performed by processing at Step S60 in main processing (described below), which is shown in FIG. 12. In a case where an ordinary pattern that is not an embroidery pattern is sewn, the embroidery frame transfer device 92 may be removed from the bed 11. Then the ordinary sewing may be performed as the work cloth is moved by the feed dog. The embroidery frame 34 has a known configuration that holds the work cloth 100 by clamping the work cloth 100 between an inner frame and an outer frame, so a detailed explanation will be omitted.

A liquid crystal display 15 that has a vertically long rectangular shape is provided on the front face of the pillar 12. A plurality of the types of patterns, names of various types of functions to be performed, various types of messages, and the like may be displayed on the liquid crystal display 15. An image of embroidery that is based on the embroidery information may be displayed on the liquid crystal display 15 by processing at Step S57 in the main processing (described below), which is shown in FIG. 12.

A transparent touch panel 26 is provided on the front face of the liquid crystal display 15. Various types of operations can be performed and settings can be made by using a user's finger or a dedicated stylus pen to touch a location on the touch panel 26 that corresponds to a screen that is displayed on the liquid crystal display 15. Hereinafter, the operation of touching the touch panel 26 is referred to as a panel operation.

The structure of the arm 13 will be explained. A top cover 16 that can be opened and closed is attached to the top portion of the arm 13. The top cover 16 is provided in the longitudinal direction of the arm 13. The top cover 16 is axially supported such that the top cover 16 can open and close by rotating around an axis that extends in the left-right direction along the upper rear edge of the arm 13. A thread spool holder 18 is provided close to the center of the top portion of the arm 13 with the top cover 16 in an opened state. The thread spool holder 18 is a recessed portion for containing a thread spool 20 that supplies thread to the sewing machine 2. A thread spool pin 19 that projects toward the head 14 is provided on an inner wall surface on the pillar 12 side of the thread spool holder 18. The thread spool 20 may be mounted in the thread spool holder 18 such that the thread spool pin 19 is inserted into an insertion hole (not shown in the drawings) with which the thread spool 20 is provided. An upper thread (not shown in the drawings) that extends from the thread spool 20 may be supplied to a needle 7 (refer to FIG. 2) through a thread guard that includes a tensioner, a thread take-up spring, a thread take-up lever, and the like that are not shown in the drawings. The tensioner is provided in the head 14 and may adjust the tension on the thread. The thread take-up lever may be driven reciprocally up and down and may pull up on the upper thread. The needle 7 may be mounted on the needle bar 6. The needle bar 6 is driven such that the needle bar 6 moves up and down by a needle bar up-and-down moving mechanism (not shown in the drawings) that is provided inside the head 14. The needle bar up-and-down moving mechanism may be driven by a drive shaft (not shown in the drawings) that is rotationally driven by a sewing machine motor 79 (refer to FIG. 3).

A switch group 25 that includes a sewing start/stop switch 21 and the like is provided on the lower portion of the front face of the arm 13. The sewing start/stop switch 21 is used to start or stop the operation of the sewing machine 2, that is, to issue commands to start or stop the sewing.

As shown in FIG. 2, the needle bar 6 and a presser bar 45 are provided on the lower side of the head 14. The needle 7 may be affixed to the lower end of the needle bar 6. A presser foot 47, which presses down on the work cloth, may be affixed to the lower end of the presser bar 45.

An electrical configuration of the sewing machine system 1 will be explained with reference to FIG. 3. First, an electrical configuration of the sewing machine 2 will be explained. As shown in FIG. 3, a control portion 60 of the sewing machine 2 includes a CPU 61, a ROM 62, a RAM 63, an EEPROM 64, and an input/output interface 65, which are connected to one another by a bus 67. The ROM 62 includes at least a program storage area 621, a decryption key storage area 622, and a machine model-related information storage area 623. Program data for performing processing by the CPU 61 are stored in the program storage area 621. Decryption keys for decrypting various types of encrypted information are stored in the decryption key storage area 622. In the present embodiment, four decryption keys, a first decryption key "ffgg", a second decryption key "hhii", a third decryption key "jjkk", and a fourth decryption key "mmnn", are stored. A machine model-related information data table 97 (refer to FIG. 8), which will be described below, is stored in the machine model-related information storage area 623.

The sewing start/stop switch 21, the touch panel 26, a USB connector 27, and drive circuits 71, 72, 74, 75, 85, and 86 are electrically connected to the input/output interface 65. The drive circuit 71 may drive the feed adjustment pulse motor 78. The drive circuit 72 may drive the sewing machine motor 79. The drive circuit 74 may drive a swinging-and-releasing pulse motor 80. The swinging-and-releasing pulse motor 80 may drive the needle bar 6 such that the needle bar 6 swings, and may perform an operation that releases the needle bar 6. The drive circuit 75 may drive the liquid crystal display 15. The drive circuits 85 and 86 may respectively drive the X axis motor 83 and the Y axis motor 84, which move the embroidery frame 34. The sewing start/stop switch 21 is a button switch. The USB memory 3 can be mounted in and removed from the USB connector 27. The USB connector 27 is not shown in detail in the drawings, but is provided on the right side face of the pillar 12. The USB connector 27 and a USB plug 33 (refer to FIG. 4) are connected when the USB memory 3 is mounted in the sewing machine 2. The CPU 61 is able to access various storage areas that are included in the USB memory 3.

Figure 4:
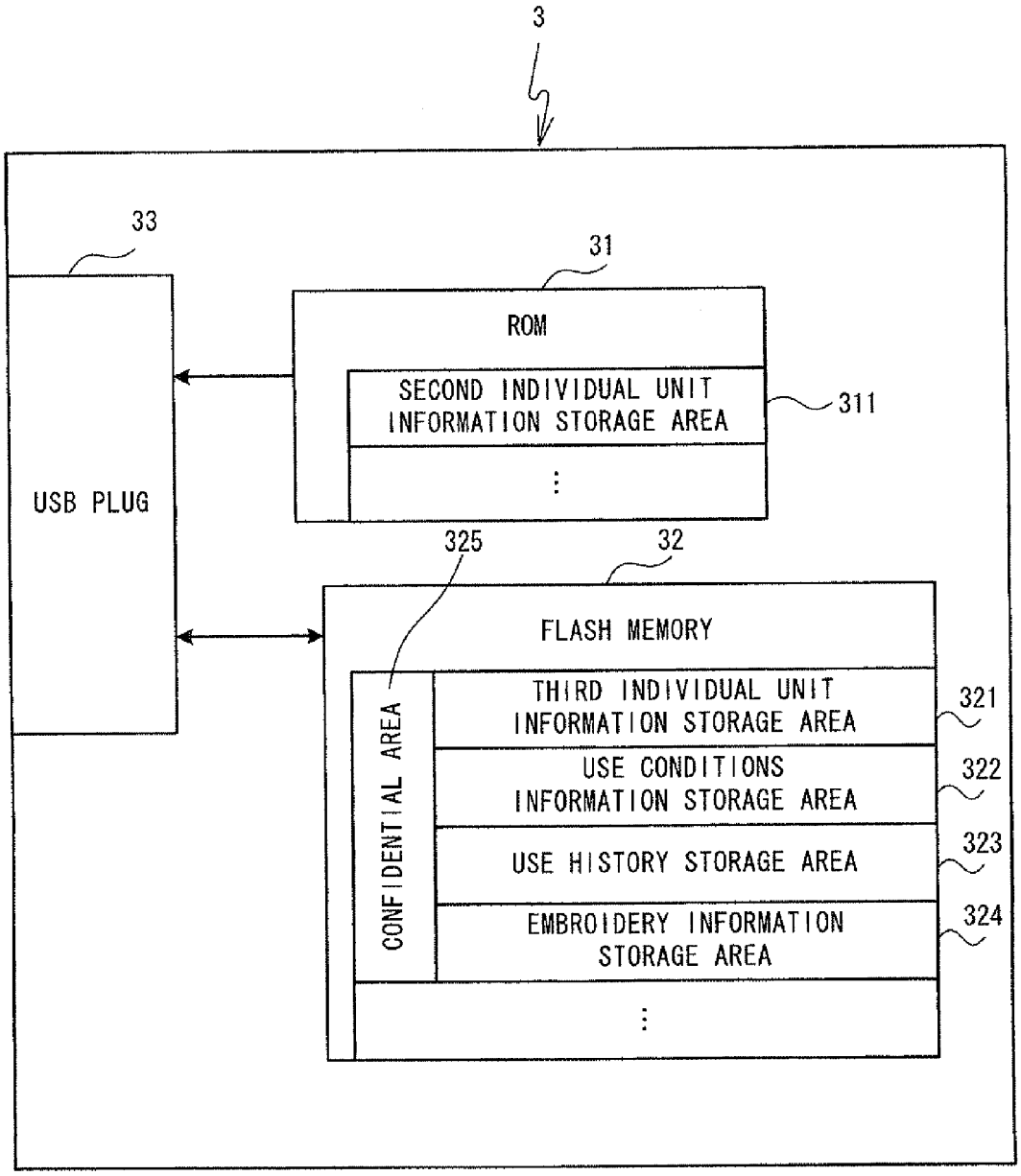
FIG. 4 is a schematic diagram that shows an electrical configuration of a USB memory 3.

An electrical configuration of the USB memory 3 will be explained with reference to FIG. 4. As shown in FIG. 4, the USB memory 3 includes at least a ROM 31, a flash memory 32, and the USB plug 33. The ROM 31 and the flash memory 32 are electrically connected to the USB plug 33.

The ROM 31 includes at least a second individual unit information storage area 311. Second individual unit information is stored in the second individual unit information storage area 311. The second individual unit information is information for identifying the individual USB memory 3. Different second individual unit information is assigned to each USB memory.

The flash memory 32 includes a confidential area 325. A third individual unit information storage area 321, a use conditions information storage area 322, a use history storage area 323, and an embroidery information storage area 324 are included in the confidential area 325. The confidential area 325 is a storage area that only specified sewing machines can access. The specified sewing machines may be, for example, sewing machines that are manufactured by the same manufacturer. Third individual unit information is stored in the third individual unit information storage area 321. The third individual unit information is individual unit information that corresponds to the second individual unit information that is stored in the second individual unit information storage area 311. A use conditions information data table 95 (refer to FIG. 6), which will be described below, is stored in the use conditions information storage area 322. A use history data table 98 (refer to FIG. 10), which will be described below, is stored in the use history storage area 323. An embroidery information data table 96 (refer to FIG. 7), which will be described below, is stored in the embroidery information storage area 324. Various types of information are stored in the various storage areas in the flash memory 32 by processing (refer to FIG. 9) by a personal computer (PC) 4, which will be described below.

The PC 4 may store various types of information in the flash memory 32 of the USB memory 3. For example, after various types of information are stored in the flash memory 32 by the PC 4 at the manufacturer's factory, the USB memory 3 may be shipped to market and sold. A user who purchases the USB memory 3 may then mount the USB memory 3 in the sewing machine 2 and may perform embroidery sewing using the embroidery information.

Figure 5:
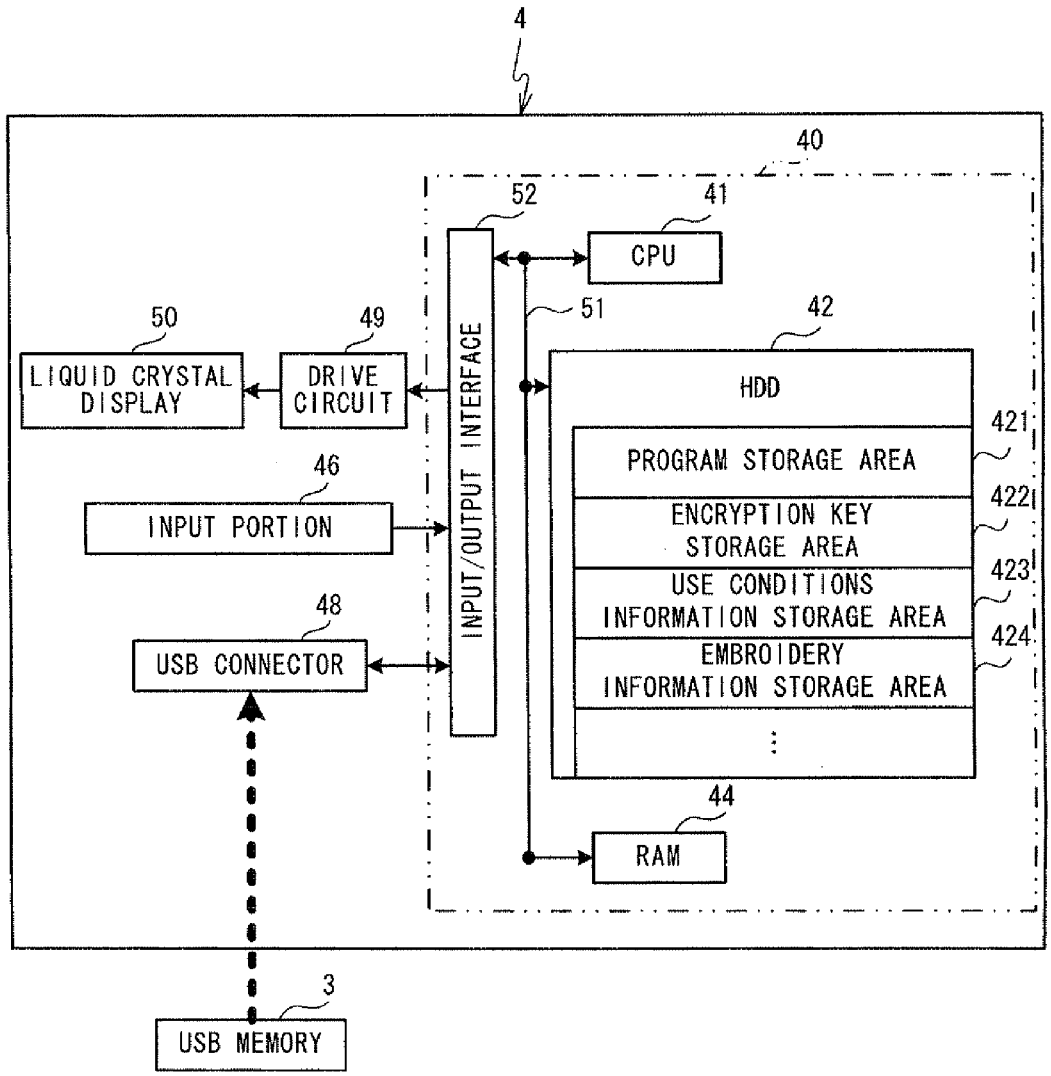
FIG. 5 is a schematic diagram that shows an electrical configuration of a personal computer 4.

An electrical configuration of the PC 4 will be explained with reference to FIG. 5. A control portion 40 of the PC 4 includes a CPU 41, an HDD 42, a RAM 44, and an input/output interface 52, which are connected to one another by a bus 51. The HDD 42 includes at least a program storage area 421, an encryption key storage area 422, a use conditions information storage area 423, and an embroidery information storage area 424. Program data for performing processing by the CPU 41 are stored in the program storage area 421.

Encryption keys for encrypting various types of information are stored in the encryption key storage area 422. In the present embodiment, four encryption keys, a first encryption key "ffgg", a second encryption key "hhii", a third encryption key "jjkk", and a fourth encryption key "mmnn", are stored. The first encryption key, the second encryption key, the third encryption key, and the fourth encryption key are the same as the first decryption key, the second decryption key, the third decryption key, and the fourth decryption key, respectively.

The use conditions information data table 95 (refer to FIG. 6) that is to be stored in the use conditions information storage area 322 of the USB memory 3 is stored in the use conditions information storage area 423. The embroidery information data table 96 (refer to FIG. 7) that is to be stored in the embroidery information storage area 324 of the USB memory 3 is stored in the embroidery information storage area 424.

An input portion 46, a USB connector 48, and a drive circuit 49 are electrically connected to the input/output interface 52. The drive circuit 49 may drive a liquid crystal display 50. The input portion 46 may be a keyboard or a mouse, for example. The CPU 41 is capable of detecting a command that has been input by a user through the input portion 46. The USB memory 3 can be mounted in and removed from the USB connector 48. When the USB memory 3 is mounted in the PC 4, the USB connector 48 and the USB plug 33 (refer to FIG. 4) may be connected. The CPU 41 is able to access the various storage areas that are included in the USB memory 3.

Figure 9:
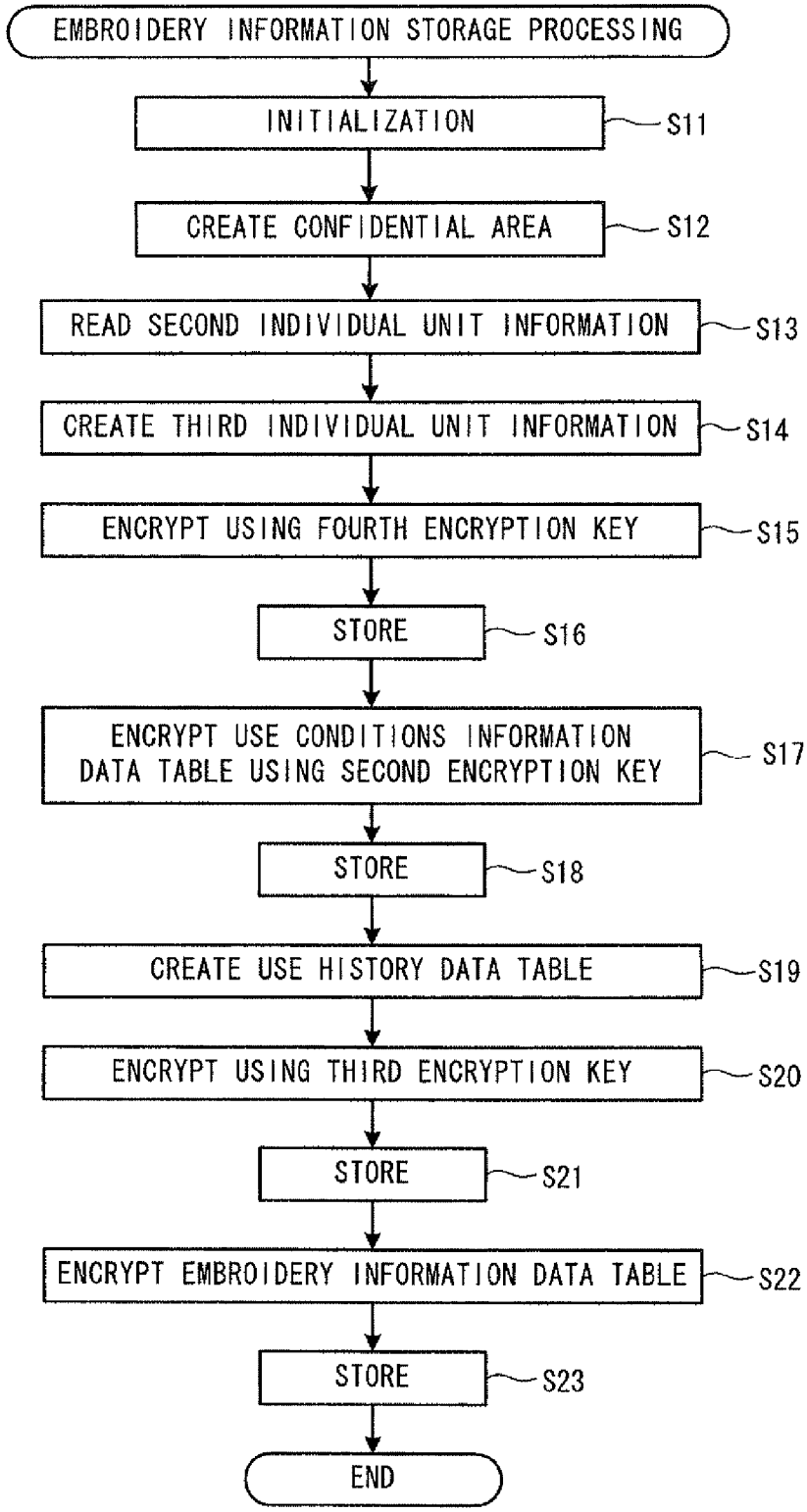
FIG. 9 is a flowchart that shows embroidery information storage processing.

The use conditions information data table 95 will be explained with reference to FIG. 6. The use conditions information data table 95 is stored in the use conditions information storage area 423 of the PC 4 (refer to FIG. 5). The use conditions information data table 95 is stored by the PC 4 in the use conditions information storage area 322 of the USB memory 3 (refer to FIG. 4) in processing at Step S18 in embroidery information storage processing (described below), which is shown in FIG. 9. Use conditions information, which is information on conditions for the sewing machines that are able to use the embroidery information, is stored in the use conditions information data table 95. In a case where the sewing machine 2 matches the use conditions information, the sewing machine 2 is able to decrypt and use the embroidery information. The details will be explained below.

As shown in FIG. 6, destination information, machine model information, and embroidery type information are stored as the use conditions information in the use conditions information data table 95. For example, the destination information corresponds to "Japan", "America", and "China". For example, the machine model information corresponds to "BB-CC", "SSS-XXX", and "DD-EEE". For example, the embroidery type information corresponds to "first copyright", "second copyright", and "ordinary".

The destination information is information on the destination for the sewing machine that can use the embroidery information. The destination is the shipping destination for the sewing machine. The machine model information is information that specifies the model of the sewing machine that can use the embroidery information. The machine model information may be a model name or a model code, for example. In the present embodiment, the machine model information is the model name. The embroidery type information is information that pertains to the type of the embroidery information that is stored in the embroidery information storage area 324 of the USB memory 3 (refer to FIG. 4). The embroidery type information "first copyright" indicates that embroidery information that is protected by a specified copyright is stored in the embroidery information storage area 324 of the USB memory 3. The embroidery information that is protected by the first copyright can be used only by a sewing machine that is permitted to use the embroidery information that is protected by the first copyright. Similarly, the embroidery type information "second copyright" indicates that embroidery information that is protected by a specified copyright that is different from the first copyright is stored in the embroidery information storage area 324 of the USB memory 3. The embroidery type information "ordinary" indicates that embroidery information that is not protected by a copyright (that does not require protection by a copyright) is stored in the embroidery information storage area 324 of the USB memory 3.

The embroidery information data table 96 will be explained with reference to FIG. 7. The embroidery information data table 96 is stored in the embroidery information storage area 424 of the PC 4 (refer to FIG. 5). The embroidery information data table 96 is stored by the PC 4 in the embroidery information storage area 324 of the USB memory 3 in processing at Step S23 in the embroidery information storage processing (described below) that is shown in FIG. 9. Various types of the embroidery information may be stored in the embroidery information data table 96.

Data that become necessary when an embroidery pattern is sewn on the work cloth 100 are included in the embroidery information. The embroidery information includes at least coordinate data (X, Y) that indicate a plurality of needle drop positions for the needle 7. When the sewing machine 2 performs embroidery sewing, the embroidery frame 34 may be moved in the X axis direction and the Y axis direction by the driving of the X axis motor 83 and the Y axis motor 84 based on the coordinate data. The embroidery sewing may be performed as the embroidery frame 34 is moved. The embroidery pattern may thus be sewn based on the embroidery information.

Figure 7:
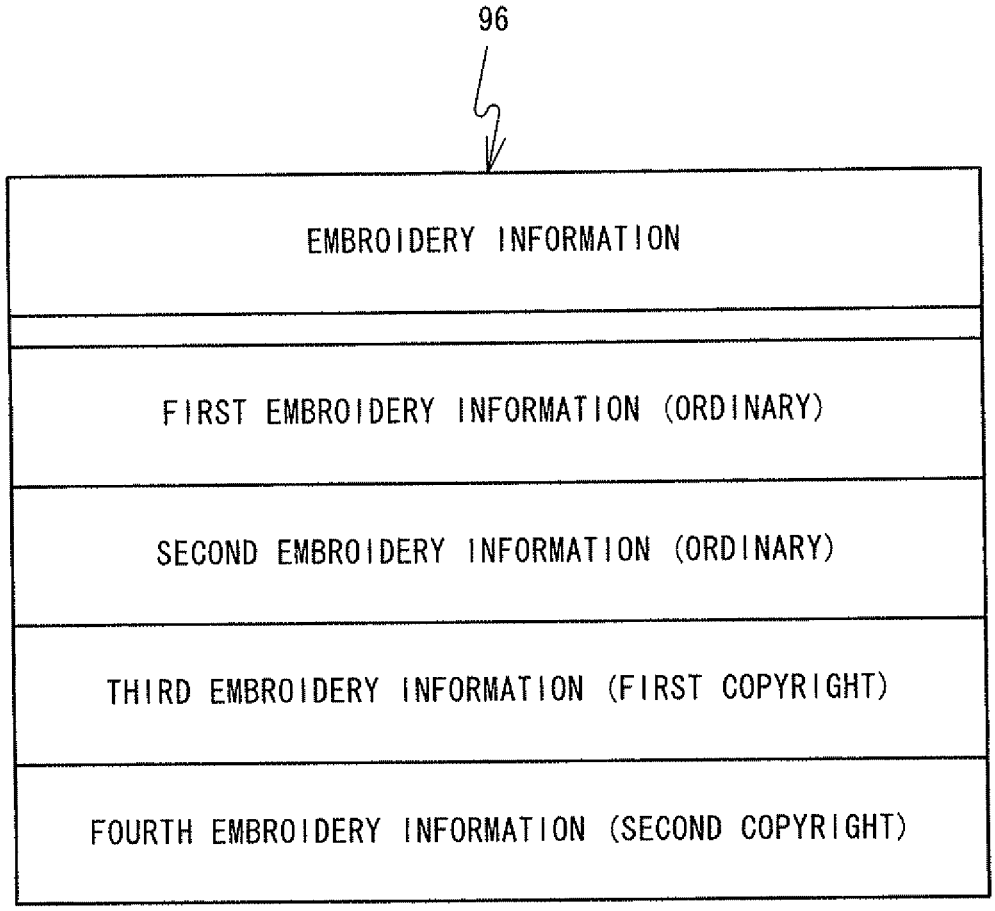
FIG. 7 is a schematic diagram that shows an embroidery information data table 96.

As shown in FIG. 7, first embroidery information, second embroidery information, third embroidery information, and fourth embroidery information are stored in the embroidery information data table 96, for example. The first embroidery information and the second embroidery information are embroidery information that is not protected by copyrights. That is, the first embroidery information and the second embroidery information are embroidery information for which the embroidery type information is "ordinary". The third embroidery information is embroidery information that is protected by the first copyright. The fourth embroidery information is embroidery information that is protected by the second copyright.

The machine model-related information data table 97 will be explained with reference to FIG. 8. The machine model-related information data table 97 is stored in the machine model-related information storage area 623 of the sewing machine 2. Various types of information about the sewing machine 2 may be stored in the machine model-related information data table 97.

As shown in FIG. 8, the first individual unit information "aabbcc", the destination information "Japan", the machine model information "SSS-XXX", and the embroidery type information "first copyright" and "ordinary" are stored in the machine model-related information data table 97, for example. These items of information indicate that the first individual unit information for the sewing machine 2 is "aabbcc", the destination is "Japan", the model name is "SSS-XXX", and the types of the embroidery information that can be used are "first copyright" and "ordinary". The first individual unit information is information for identifying the individual sewing machine. Different first individual unit information is assigned to each sewing machine.

The embroidery information storage processing that is performed by the CPU 41 of the PC 4 will be explained with reference to FIG. 9. The embroidery information storage processing is processing that stores various types of information, such as the embroidery information and the like, in the flash memory 32 of the USB memory 3 (refer to FIG. 4). The embroidery information storage processing may be started when the USB memory 3 is connected to the PC 4.

Figure 11:
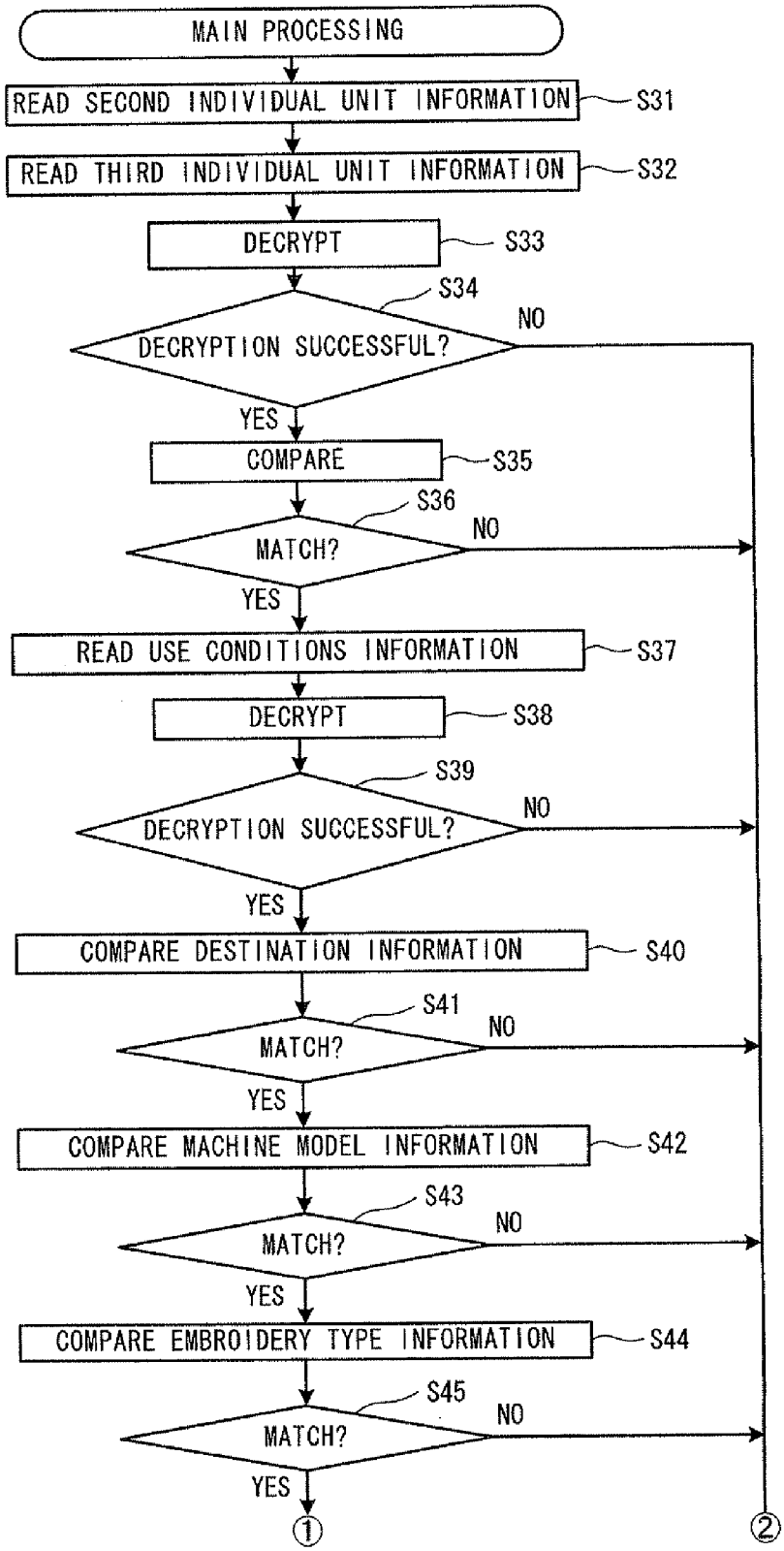
FIG. 11 is a portion of a flowchart that shows main processing.

In the embroidery information storage processing, first, formatting of the flash memory 32 of the USB memory 3 is carried out, and the storage areas of the flash memory 32 are initialized (Step S11). Next, the confidential area 325 is created in the storage areas of the flash memory 32 (Step S12). Next, the second individual unit information is read from the second individual unit information storage area 311 of the ROM 31 of the USB memory 3 (Step S13). Next, the third individual unit information, which corresponds to the second individual unit information, is created from the second individual unit information that has been read (Step S14). In the present embodiment, the second individual unit information is "abcd", for example. The third individual unit information that is created by the processing at Step S14 is the same "abcd" as the second individual unit information, for example. The second individual unit information and the third individual unit information being the same is merely an example. The second individual unit information and the third individual unit information may be different, as long as the second individual unit information and the third individual unit information have a relationship of correspondence such that the second individual unit information and the third individual unit information can be compared in processing at Step S35 (described below), which is shown in FIG. 11, in the main processing of the sewing machine 2.

Next, the third individual unit information that has been created is encrypted such that the third individual unit information can be decrypted using the fourth decryption key (Step S15). The encryption key that is used in the processing at Step S15 may be the fourth encryption key, which is stored in the encryption key storage area 422 of the PC 4. In the present embodiment, both the fourth encryption key and the fourth decryption key are the same "mmnn", for example. Next, the encrypted third individual unit information is stored in the confidential area 325 of the USB memory 3 (Step S16). The storage area in which the third individual unit information is stored by the processing at Step S16 is the third individual unit information storage area 321 (refer to FIG. 4).

Next, the use conditions information data table 95 (refer to FIG. 6) that is stored in the use conditions information storage area 423 of the PC 4 is encrypted such that the use conditions information data table 95 can be decrypted using the second decryption key (Step S17). The encryption key that is used in the processing at Step S17 may be the second encryption key, which is stored in the encryption key storage area 422 of the PC 4. In the present embodiment, both the second encryption key and the second decryption key are the same "hhii", for example. Next, the encrypted use conditions information data table 95 is stored in the confidential area 325 of the USB memory 3 (Step S18). The storage area in which the use conditions information data table 95 is stored by the processing at Step S18 is the use conditions information storage area 322.

Figure 10:
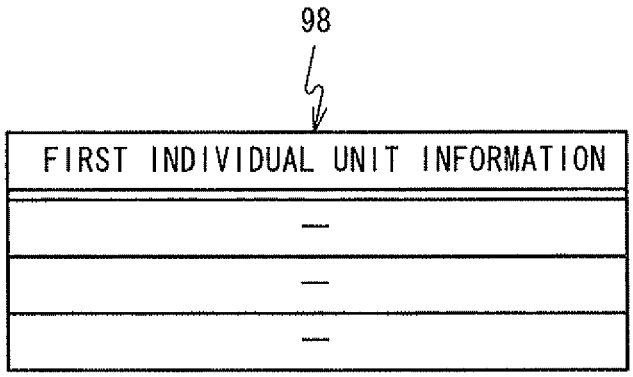
FIG. 10 is a schematic diagram that shows a use history data table 98.

Next, the use history data table 98, which is a data table in which a specified number of the first individual unit information records can be stored, is created (Step S19). In the present embodiment, the specified number is set to 3, on the assumption that the user may be an individual who owns (uses) that number of sewing machines. However, the specified number is not limited to being 3. In the present case, as shown in FIG. 10, the use history data table 98 is created such that three first individual unit information records can be stored. In FIG. 10, the dashes indicate that the first individual unit information has not been stored.

Next, the created use history data table 98 is encrypted such that the created use history data table 98 can be decrypted using the third decryption key (Step S20). The encryption key that is used in the processing at Step S20 may be the third encryption key, which is stored in the encryption key storage area 422 of the PC 4. In the present embodiment, both the third encryption key and the third decryption key are the same "jjkk", for example. Next, the encrypted use history data table 98 is stored in the confidential area 325 of the USB memory 3 (Step S21). The storage area in which the use history data table 98 is stored by the processing at Step S21 is the use history storage area 323.

Next, the embroidery information data table 96 (refer to FIG. 7) that is stored in the embroidery information storage area 424 of the PC 4 is encrypted such that the embroidery information data table 96 can be decrypted using the first decryption key (Step S22). The encryption key that is used in the processing at Step S22 may be the first encryption key, which is stored in the encryption key storage area 422 of the PC 4. In the present embodiment, both the first encryption key and the first decryption key are the same "ffgg", for example. Next, the encrypted embroidery information is stored in the confidential area 325 of the USB memory 3 (Step S23). The storage area in which the embroidery information data table 96 is stored by the processing at Step S23 is the embroidery information storage area 324. The sewing machine 2 is able to individually read the individual embroidery infatuation items that are stored in the embroidery information data table 96 in their encrypted state. After the processing at Step S23 has been performed, the embroidery information storage processing is terminated.

The embroidery information storage processing is performed as explained above. Various types of information, such as the embroidery information and the like, may be encrypted and stored in the USB memory 3 by the embroidery information storage processing. After the embroidery information storage processing has been performed, the USB memory 3 may be shipped to market.

The main processing that is performed by the CPU 61 of the sewing machine 2 will be explained with reference to FIGS. 11 and 12. The main processing may be started when the USB memory 3 is mounted in the USB connector 27 of the sewing machine 2. In the explanation that follows, a specific example will be explained in which the USB memory 3 that is mounted in the USB connector 27 is one in which various types of information have been stored by the above-described embroidery information storage processing (refer to FIG. 9) in the PC 4.

As shown in FIG. 11, in the main processing, first, the second individual unit information that is stored in the second individual unit information storage area 311 of the USB memory 3 is read (Step S31). The second individual unit information that has been read is stored in the RAM 63. Even in a case where various types of information are read by other processing, the information that has been read may be stored in the RAM 63 in the same manner. Next, the third individual unit information that is stored in the third individual unit information storage area 321 of the USB memory 3 is read (Step S32). Next, the third individual unit information that has been read is decrypted using the fourth decryption key that is stored in the decryption key storage area 622 of the sewing machine 2 (Step S33). Next, a determination is made as to whether the decryption by the processing at Step S33 succeeded (Step S34). In the specific example, the decryption succeeds, because the fourth encryption key "mmnn" and the fourth decryption key "mmnn" match.

If the decryption has not succeeded (NO at Step S34), the main processing is terminated. If the decryption has succeeded (YES at Step S34), a comparison is made as to whether the second individual unit information and the third individual unit information match (Step S35). In the specific example, the second individual unit information and the third individual unit information are both "abed", so the second individual unit information and the third individual unit information do match.

Next, a determination is made as to whether the result of the comparison by the processing at Step S35 is that the second individual unit information and the third individual unit information match (Step S36). If the second individual unit information and the third individual unit information do not match (NO at Step S36), the main processing is terminated. If the second individual unit information and the third individual unit information do match (YES at Step S36), the use conditions information data table 95 that is stored in the use conditions information storage area 322 of the USB memory 3 is read (Step S37). Next, the use conditions information data table 95 that has been read is decrypted using the second decryption key that is stored in the decryption key storage area 622 (Step S38). Next, a determination is made as to whether the decryption by the processing at Step S38 succeeded (Step S39). In the specific example, the decryption succeeds, because the second encryption key "hhii" and the second decryption key "hhii" match.

If the decryption has not succeeded (NO at Step S39), the main processing is terminated. If the decryption has succeeded (YES at Step S39), processing at Steps S40 to S45 is performed. In the processing at Steps S40 to S45, the use conditions information that is stored in the use conditions information storage area 322 of the USB memory 3 is referenced, and a determination is made as to whether the sewing machine 2 corresponds to the use conditions information. In a case where the sewing machine 2 does not correspond to the use conditions (NO at Step S41, NO at Step S43, NO at Step S45, which will be described below), the main processing is terminated.

A comparison is made as to whether destination information that matches the destination information that is stored in the machine model-related information data table 97 in the sewing machine 2 is present in the destination information that is included in the use conditions information data table 95 (Step S40). Next, a determination is made as to whether the result of the comparison by the processing at Step S40 is that the matching destination information is present (Step S41). In the specific example, the destination information that is stored in the machine model-related information data table 97 (refer to FIG. 8) is "Japan". Further, the destination information "Japan" is stored in the use conditions information data table 95 (refer to FIG. 6). Therefore, a determination is made that the matching destination information is present (YES at Step S41).

If the matching destination information is not present (NO at Step S41), the main processing is terminated. If the matching destination information is present (YES at Step S41), a comparison is made as to whether machine model information that matches the machine model information that is stored in the machine model-related information data table 97 in the sewing machine 2 is present in the machine model information that is included in the use conditions information data table 95 (Step S42). Next, a determination is made as to whether the result of the comparison by the processing at Step S42 is that the matching machine model information is present (Step S43). In the specific example, the machine model information that is stored in the machine model-related information data table 97 (refer to FIG. 8) is "SSS-XXX". The machine model information "SSS-XXX" is stored in the machine model information that is stored in the use conditions information data table 95 (refer to FIG. 6). Therefore, a determination is made that the matching machine model information is present (YES at Step S43).

If the matching machine model information is not present (NO at Step S43), the main processing is terminated. If the matching machine model information is present (YES at Step S43), a comparison is made as to whether embroidery type information that matches the usable embroidery type information that is stored in the machine model-related information data table 97 in the sewing machine 2 is present in the embroidery type information that is included in the use conditions information data table 95 (Step S44). Next, a determination is made as to whether the result of the comparison by the processing at Step S44 is that the matching embroidery type information is present (Step S45). In the specific example, the usable embroidery type information that is stored in the machine model-related information data table 97 (refer to FIG. 8) is "first copyright" and "ordinary". Further, "first copyright" and "ordinary" are stored in the embroidery type information that is stored in the use conditions information data table 95 (refer to FIG. 6). Therefore, a determination is made that the matching embroidery type information is present (YES at Step S45).

If the matching embroidery type information is not present (NO at Step S45), the main processing is terminated. If the matching embroidery type information is present (YES at Step S45), the use history data table 98 (refer to FIG. 10) is read from the use history storage area 323 of the USB memory 3 (Step S46), as shown in FIG. 12. Next, the use history data table 98 that has been read is decrypted using the third decryption key that is stored in the decryption key storage area 622 (Step S47). In other words, the first individual unit information that is stored in the use history storage area 323 is decrypted. Next, a determination is made as to whether the decryption by the processing at Step S47 succeeded (Step S48). In the specific example, the decryption succeeds, because the third encryption key "jjkk" and the third decryption key "jjkk" match.

If the decryption has not succeeded (NO at Step S48), the main processing is terminated. If the decryption has succeeded (YES at Step S48), a comparison is made as to whether first individual unit information that matches the first individual unit information that is stored in the machine model-related information data table 97 in the sewing machine 2 is present in the first individual unit information that is stored in the use history data table 98 (refer to FIG. 10) (Step S49). Next, a determination is made as to whether the result of the comparison by the processing at Step S49 is that the matching first individual unit information is present (Step S50). In other words, a determination is made as to whether the first individual unit information for the sewing machine 2 is stored in the use history storage area 323. In the case of the specific example, the first individual unit information that is stored in the machine model-related information data table 97 (refer to FIG. 8) is "aabbcc". No first individual unit information exists that is stored in the use history data table 98 (refer to FIG. 10). Therefore, a determination is made that the matching first individual unit information is not present.

If the matching first individual unit information is present (YES at Step S50), processing at Step S54, which will be described below, is performed. If the matching first individual unit information is not present (NO at Step S50), a determination is made as to whether the number of the first individual unit information records that are stored in the use history data table 98 is less than the specified number (3 in the present embodiment) (Step S51). In other words, a determination is made as to whether the number of the first individual unit information records that are stored in the use history storage area 323 is less than the specified number. In a case where it is determined that the first individual unit information for the sewing machine 2 is stored in the use history storage area 323 (YES at Step S50), as well as in a case where it is determined that the number of the first individual unit information records that are stored in the use history storage area 323 is less than the specified number (YES at Step S51), the embroidery information is decrypted (Step S55, described below), and embroidery sewing is performed using the embroidery information (Step S60, described below). In other words, in the processing at Steps S50 and S51, a determination is made as to whether or not the embroidery information that is stored in the embroidery information storage area 324 can be used.

If the number of the first individual unit information records that are stored in the use history data table 98 is not less than the specified number (NO at Step S51), the main processing is terminated. If the number of the records is less than the specified number (YES at Step S51), the first individual unit information that is stored in the machine model-related information data table 97 of the sewing machine 2 is registered in the use history data table 98 that was decrypted at Step S47, and the use history data table 98 is then encrypted such that the use history data table 98 can be decrypted using the third decryption key (Step S52). In the specific example, the third decryption key and the third encryption key are the same "jjkk", so the use history data table 98 is encrypted using "jjkk" as the encryption key. In a case where the third decryption key and the third encryption key are not the same, for example, the encryption may be performed using a third encryption key that is stored in the ROM 62 in advance.

Next, the use history data table 98 that has been encrypted by the processing at Step S52 is stored in the use history storage area 323 of the USB memory 3 (Step S53). In other words, the first individual unit information for the sewing machine 2 is stored in the use history storage area 323 of the USB memory 3. In the case of the specific example, the use history data table 98 that is shown in FIG. 10 is updated as shown in FIG. 13 (Step S53). As shown in FIG. 13, the first individual unit information "aabbcc" for the sewing machine 2 has been added to the use history data table 98 and stored.

Next, the embroidery information that is stored in the embroidery information storage area 324 of the USB memory 3 is read (Step S54). In the processing at Step S54, the embroidery information is read that corresponds to the embroidery type information that was determined to be matching by the processing at Step S45. In the specific example, the embroidery type information that was determined to be matching by the processing at Step S45 is "first copyright" and "ordinary". Therefore, in the processing at Step S54, the first embroidery information, the second embroidery information, and the third embroidery information in the embroidery information data table 96 (refer to FIG. 7) are read.

Next, the embroidery information that has been read by the processing at Step S54 is decrypted using the first decryption key that is stored in the decryption key storage area 622 (Step S55). Next, a determination is made as to whether the decryption by the processing at Step S55 succeeded (Step S56). In the specific example, the decryption succeeds, because the first encryption key "ffgg" and the first decryption key "ffgg" match.

If the decryption has not succeeded (NO at Step S56), the main processing is terminated. If the decryption has succeeded (YES at Step S56), an image of the embroidery pattern that is based on the decrypted embroidery information is displayed on the liquid crystal display 15 (Step S57). In the specific example, a list of images of the embroidery patterns that are based on the first embroidery information, the second embroidery information, and the third embroidery information is displayed. The user may select the embroidery information by using a panel operation to select the image of the corresponding embroidery pattern.

Next, a determination is made as to whether the embroidery information has been selected by a panel operation (Step S58). The CPU 61 waits for as long as the embroidery information has not been selected (NO at Step S58). If the embroidery information has been selected (YES at Step S58), a determination is made as to whether a command to start sewing has been input (Step S59). The user may input the command to start sewing by pressing the sewing start/stop switch 21. The CPU 61 waits for as long as the command to start sewing is not input (NO at Step S59). If the command to start sewing has been input (YES at Step S59), embroidery sewing is performed based on the embroidery information that was selected by the processing at Step S58 (Step S60). The embroidery pattern is thus sewn on the work cloth 100. After the embroidery sewing has been performed by the processing at Step S60, the main processing is terminated.

The processing according to the present embodiment is performed as explained above. In the specific example, when the main processing is performed one time, the first individual unit information "aabbcc" for the sewing machine 2 is stored in the use history data table 98 (refer to FIG. 13). Therefore, when the embroidery sewing is subsequently performed using the embroidery information that is stored in the USB memory 3, the determination is made in the processing at Step S50 that the first individual unit information that matches the first individual unit information "aabbcc" for the sewing machine 2 is present (YES at Step S50). Then the embroidery information is decrypted (Step S55), and the embroidery sewing is performed (Step S60). In other words, if the embroidery information has been decrypted once, the embroidery information that is stored in the embroidery information storage area 324 of the USB memory 3 can continue to be decrypted and used thereafter.

For example, a case is considered in which the embroidery information in the USB memory 3 is decrypted and used by another three sewing machines before the USB memory 3 is mounted in the sewing machine 2. In such a case, the first individual unit information may be stored in the use history data table 98 as shown in FIG. 14. In FIG. 14, the first individual unit information records "ddeeff", "gghhii", and "jjkkmm", which are different from the first individual unit information "aabbcc" for the sewing machine 2, may be stored in the use history data table 98. In this case, the determination is made in the processing at Step S50 that the first individual unit information that matches the first individual unit information "aabbcc" for the sewing machine 2 is not present (NO at Step S50). It is then determined that the number of the first individual unit information records that are stored in the use history data table 98 is not less than 3 (NO at Step S51). The main processing is then terminated without the embroidery information being decrypted. In other words, in the present embodiment, the embroidery information can be decrypted in a case where the number of the first individual unit information records that are stored in the use history storage area 323 is less than the specified number. Accordingly, the number of the sewing machines that can use the embroidery information that is stored in the embroidery information storage area 324 of the USB memory 3 can be restricted to not greater than the specified number of sewing machines.

The use history data table 98 in the USB memory 3 can store only the specified number of the first individual unit information records. In other words, a number of the first individual unit information records that exceeds the specified number cannot be stored in the use history storage area 323. Therefore, the number of the sewing machines that can use the embroidery information can be restricted to not greater than the specified number.

In the present embodiment, the use conditions information data table 95 is also encrypted, in addition to the embroidery information. Therefore, the possibility that the embroidery information will be used improperly can be further reduced.

The first individual unit information that is stored in the use history storage area 323 is encrypted. Therefore, the possibility that the embroidery information will be used improperly can be reduced even more.

The embroidery information storage area 324, the use conditions information storage area 322, and the use history storage area 323 are provided in the confidential area 325, which can be accessed only by a specified sewing machine. Therefore, a sewing machine other than the specified sewing machine cannot access the embroidery information storage area 324, the use conditions information storage area 322, and the use history storage area 323. Accordingly, the possibility that the embroidery information will be used improperly can be reduced even more.

The embroidery information is decrypted (Step S55) only in a case where the second individual unit information and the third individual unit information match (YES at Step S36). For example, in a case where the third individual unit information and the embroidery information that is stored in the flash memory 32 of the USB memory 3 are improperly copied to another storage medium, the second individual unit information and the third individual unit information will not match (NO at Step S36). Accordingly, the sewing machine 2 cannot decrypt the embroidery information. It is thus possible to prevent the embroidery information that has been improperly copied to the other storage medium from being used.

The present disclosure is not limited to the embodiment that is described above, and various types of modifications are possible. For example, in the embodiment that is described above, the first decryption key, the second decryption key, the third decryption key, and the fourth decryption key are separate decryption keys. However, not all of the decryption keys have to be different. For example, at least two of the first decryption key, the second decryption key, the third decryption key, and the fourth decryption key may be the same decryption key. In that case, it is not necessary for each of the first decryption key, the second decryption key, the third decryption key, and the fourth decryption key to be stored separately. It is therefore possible to reduce the storage area for the decryption key storage area 622.

In the embodiment that is described above, the first encryption key, the second encryption key, the third encryption key, and the fourth encryption key are the same as the first decryption key, the second decryption key, the third decryption key, and the fourth decryption key, respectively. However, it is acceptable, for example, for the first encryption key, the second encryption key, the third encryption key, and the fourth encryption key not to be the same as the first decryption key, the second decryption key, the third decryption key, and the fourth decryption key, respectively. For example, the first encryption key, the second encryption key, the third encryption key, and the fourth encryption key may respectively correspond to the first decryption key, the second decryption key, the third decryption key, and the fourth decryption key, and the various types of information may be encrypted such that the various types of information can be decrypted using the respective ones of the first to the fourth decryption keys.

In the embodiment that is described above, the third individual unit information storage area 321, the use conditions information storage area 322, the use history storage area 323, and the embroidery information storage area 324 are all provided in the confidential area 325 (refer to FIG. 4). However, it is acceptable, for example, for not all of the third individual unit information storage area 321, the use conditions information storage area 322, the use history storage area 323, and the embroidery information storage area 324 to be provided in the confidential area 325. For example, it is acceptable for at least one of the third individual unit information storage area 321, the use conditions information storage area 322, the use history storage area 323, and the embroidery information storage area 324 to be provided in the confidential area 325. Even in that case, a sewing machine other than the specified sewing machine cannot access the confidential area 325. Accordingly, the possibility that the embroidery information will be used improperly can be reduced. It is acceptable for the confidential area 325 not to be provided.

In the embodiment that is described above, the embroidery information is stored in the USB memory 3. However, it is acceptable for the embroidery information not to be stored in the USB memory 3. For example, the embroidery information may be stored in another storage medium, such as a memory card or the like.

In the embodiment that is described above, the use conditions information includes the destination information, the machine model information, and the embroidery type information. Further, in the processing at Steps S41, S43, and S45 in the main processing that are shown in FIG. 11, the determination is made as to whether the sewing machine 2 matches the use conditions information. However, for example, the use conditions information may be other information. For example, the use conditions information for determining whether the sewing machine 2 matches the use conditions information may be only one of the destination information, the machine model information, and the embroidery type information. The use conditions information may be the year-month-day of manufacture or the like.

In the embodiment that is described above, in the processing at Step S50 in the main processing that is shown in FIG. 12, the determination is made as to whether the matching first individual unit information is present. Then in a case where it is determined that the matching first individual unit information is not present (NO at Step S50), a determination is made as to whether the number of the first individual unit information records that are stored in the use history data table 98 is less than the specified number (3 in the present embodiment) (Step S51). However, one of the processing at Step S50 and the processing at Step S51 may be omitted. In that case, the determination as to whether the embroidery information that is stored in the embroidery information storage area 324 can be used may be made by only one of the processing at Step S50 and the processing at Step S51.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine system comprising:

a sewing machine and a storage device that can be mounted to and removed from the sewing machine, wherein:

the storage device comprises:

an embroidery information storage portion that is configured to store embroidery information that is information for the sewing machine to perform embroidery sewing, that is encrypted, and that can be decrypted by using a first decryption key;

a conditions information storage portion that is configured to store use conditions information that is information on conditions for a sewing machine that can use the embroidery information; and a use history storage portion that is configured to store a specified number of records of first individual unit information for respective sewing machines that have used the embroidery information, each of the records of the first individual unit information identifying an individual sewing machine, and the sewing machine comprises:

a mounting portion to and from which the storage device can be mounted and removed;

a first individual unit information storage portion that stores the first individual unit information of the sewing machine;

a use conditions determination portion that determines whether the sewing machine corresponds to the use conditions information by referencing the use conditions information that is stored in the conditions information storage portion of the storage device that is mounted in the mounting portion;

a usability determination portion that, in a case where it has been determined by the use conditions determination portion that the sewing machine corresponds to the use conditions information, determines whether the embroidery information that is stored in the embroidery information storage portion can be used, by at least one of determining whether a number of records of the first individual unit information that are stored in the use history storage portion is less than the specified number and determining whether the first individual unit information of the sewing machine is stored in the use history storage portion;

a first decryption portion that, in a case where it has been determined by the usability determination portion that the embroidery information that is stored in the embroidery information storage portion can be used, decrypts the embroidery information that is stored in the embroidery information storage portion by using the first decryption key, the first decryption key being stored in a decryption key storage portion that stores a decryption key;

an individual unit information storage control portion that, in a case where it has been determined by the usability determination portion that the number of the records of the first individual unit information that are stored in the use history storage portion is less than the specified number and thus the embroidery information that is stored in the embroidery information storage portion can be used, stores in the use history storage portion the first individual unit information that is stored in the first individual unit information storage portion; and an embroidery portion that performs embroidery sewing on a cloth, using the embroidery information that has been decrypted by the first decryption portion.

2. The sewing machine system according to claim 1, wherein the use conditions information that is stored in the conditions information storage portion of the storage device is encrypted and can be decrypted by using a second decryption key, the sewing machine further comprises a second decryption portion that, by using the second decryption key that is stored in the decryption key storage portion, decrypts the use conditions information that is stored in the conditions information storage portion, the use conditions determination portion determines whether the sewing machine corresponds to the use conditions information by referencing the use conditions information that has been decrypted by the second decryption portion.

3. The sewing machine system according to claim 1, wherein the first individual unit information that is stored in the use history storage portion of the storage device is encrypted and can be decrypted by using a third decryption key, the sewing machine further comprises a third decryption portion that, by using the third decryption key that is stored in the decryption key storage portion, decrypts the first individual unit information that is stored in the use history storage portion, the usability determination portion determines whether the embroidery information that is stored in the embroidery information storage portion can be used, by referencing the first individual unit information that has been decrypted by the third decryption portion, and the individual unit information storage control portion encrypts the first individual unit information that is stored in the first individual unit information storage portion such that the first individual unit information can be decrypted by using the third decryption key, and stores in the use history storage portion the first individual unit information that has been encrypted.

4. The sewing machine system according to claim 1, wherein at least one of the embroidery information storage portion, the conditions information storage portion, and the use history storage portion of the storage device is provided in a confidential area that is a storage area that only a specified sewing machine is able to access, and the sewing machine is able to access the confidential area.

5. The sewing machine system according to claim 4, wherein the storage device further comprises:

a second individual unit information storage portion that is configured to store second individual unit information identifying the storage device; and a third individual unit information storage portion that is configured to store third individual unit information that corresponds to the second individual unit information stored in the second individual unit information storage portion, that is stored in the confidential area, that has been encrypted, and that can be decrypted by using a fourth decryption key, the sewing machine further comprises an individual unit information determination portion that determines whether the second individual unit information corresponds to third individual unit information, the second individual unit information being stored in the second individual unit information storage portion, and the third individual unit information being stored in the third individual unit information storage portion, the first decryption portion is able to decrypt the embroidery information that is stored in the embroidery information storage portion only in a case where it has been determined by the individual unit information determination portion that the second individual unit information corresponds to the third individual unit information.

6. The sewing machine system according to claim 5, wherein at least two of the first decryption key, the second decryption key, the third decryption key, and the fourth decryption key are the same key.

7. A sewing machine comprising:

a mounting portion to and from which a storage device can be mounted and removed, the storage device including an embroidery information storage portion, a conditions information storage portion, and a use history storage portion, the embroidery information storage portion being configured to store embroidery information that is information for a sewing machine to perform embroidery sewing, that is encrypted, and that can be decrypted by using a first decryption key, the conditions information storage portion being configured to store use conditions information that is information on conditions for a sewing machine that can use the embroidery information, and the use history storage portion being configured to store a specified number of records of first individual unit information for respective sewing machines that have used the embroidery information, each of the records of the first individual unit information identifying an individual sewing machine;

a first individual unit information storage portion that stores the first individual unit information of the sewing machine;

a use conditions determination portion that determines whether the sewing machine corresponds to the use conditions information by referencing the use conditions information that is stored in the conditions information storage portion of the storage device that is mounted in the mounting portion;

a usability determination portion that, in a case where it has been determined by the use conditions determination portion that the sewing machine corresponds to the use conditions information, determines whether the embroidery information that is stored in the embroidery information storage portion can be used, by at least one of determining whether a number of records of the first individual unit information that are stored in the use history storage portion is less than the specified number and determining whether the first individual unit information of the sewing machine is stored in the use history storage portion;

a first decryption portion that, in a case where it has been determined by the usability determination portion that the embroidery information that is stored in the embroidery information storage portion can be used, decrypts the embroidery information that is stored in the embroidery information storage portion by using the first decryption key, the first decryption key being stored in a decryption key storage portion that stores a decryption key;

an individual unit information storage control portion that, in a case where it has been determined by the usability determination portion that the number of the records of the first individual unit information that are stored in the use history storage portion is less than the specified number and thus the embroidery information that is stored in the embroidery information storage portion can be used, stores in the use history storage portion the first individual unit information that is stored in the first individual unit information storage portion; and an embroidery portion that performs embroidery sewing on a cloth, using the embroidery information that has been decrypted by the first decryption portion.

8. The sewing machine according to claim 7, further comprising:

a second decryption portion that, by using a second decryption key that is stored in the decryption key storage portion, decrypts the use conditions information that is stored in the conditions information storage portion of the storage device, that has been encrypted, and that can be decrypted by using the second decryption key, wherein the use conditions determination portion determines whether the sewing machine corresponds to the use conditions information by referencing the use conditions information that has been decrypted by the second decryption portion.

9. The sewing machine according to claim 7, further comprising:

a third decryption portion that, by using a third decryption key that is stored in the decryption key storage portion, decrypts the first individual unit information that is stored in the use history storage portion of the storage device, that has been encrypted, and that can be decrypted by using the third decryption key, wherein the usability determination portion determines whether the embroidery information that is stored in the embroidery information storage portion can be used, by referencing the first individual unit information that has been decrypted by the third decryption portion, and the individual unit information storage control portion encrypts the first individual unit information that is stored in the first individual unit information storage portion such that the first individual unit information can be decrypted by using the third decryption key, and stores in the use history storage portion the first individual unit information that has been encrypted.

10. The sewing machine according to claim 7, wherein the sewing machine, in a case where at least one of the embroidery information storage portion, the conditions information storage portion, and the use history storage portion of the storage device is provided in a confidential area that is a storage area that only a specified sewing machine is able to access, is able to access the confidential area.

11. The sewing machine according to claim 10, further comprising:

an individual unit information determination portion that determines whether second individual unit information corresponds to third individual unit information, the second individual unit information identifying the storage device and being stored in the storage device, and the third individual unit information being information that corresponds to the second individual unit information, that is stored in the confidential area, that has been encrypted, and that can be decrypted by using a fourth decryption key, wherein the first decryption portion is able to decrypt the embroidery information that is stored in the embroidery information storage portion only in a case where it has been determined by the individual unit information determination portion that the second individual unit information corresponds to the third individual unit information.

12. The sewing machine according to claim 11, wherein at least two of the first decryption key, the second decryption key, the third decryption key, and the fourth decryption key are the same key.

13. A storage device that can be mounted to and removed from a sewing machine, comprising:

an embroidery information storage portion that is configured to store embroidery information that is information for the sewing machine to perform embroidery sewing, that is encrypted, and that can be decrypted by using a first decryption key stored in the sewing machine;

a conditions information storage portion that is configured to store use conditions information that is information on conditions for a sewing machine that can use the embroidery information; and a use history storage portion that is configured to store a specified number of records of first individual unit information for respective sewing machines that have used the embroidery information, each of the records of the first individual unit information identifying an individual sewing machine.

14. The storage device according to claim 13, wherein the use conditions information that is stored in the conditions information storage portion is encrypted and can be decrypted by using a second decryption key that is stored in the sewing machine.

15. The storage device according to claim 13, wherein the first individual unit information that is stored in the use history storage portion is encrypted and can be decrypted by using a third decryption key that is stored in the sewing machine.

16. The storage device according to claim 13, wherein at least one of the embroidery information storage portion, the conditions information storage portion, and the use history storage portion is provided in a confidential area that is a storage area that only a specified sewing machine is able to access.

17. The storage device according to claim 16, further comprising:

a second individual unit information storage portion that is configured to store second individual unit information identifying the storage device; and a third individual unit information storage portion that is configured to store third individual unit information that corresponds to the second individual unit information stored in the second individual unit information storage portion, that is stored in the confidential area, that has been encrypted, and that can be decrypted by using a fourth decryption key.

18. The storage device according to claim 17, wherein at least two of the first decryption key, the second decryption key, the third decryption key, and the fourth decryption key are the same key.

* * * * *